US007564004B2

(12) United States Patent
Nishimura et al.

(10) Patent No.: US 7,564,004 B2
(45) Date of Patent: Jul. 21, 2009

(54) SWITCH DEVICE

(75) Inventors: Kenji Nishimura, Osaka (JP); Kenji Yasufuku, Fukui (JP); Yasuchika Kudo, Fukui (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/955,557

(22) Filed: Dec. 13, 2007

(65) Prior Publication Data

US 2008/0217156 A1 Sep. 11, 2008

(30) Foreign Application Priority Data

Mar. 8, 2007 (JP) ..... 2007-058043

(51) Int. Cl.
*H01H 1/36* (2006.01)

(52) U.S. Cl. ..... 200/536

(58) Field of Classification Search ..... 200/16 R–16 D, 200/292–296, 303, 547, 548, 536
See application file for complete search history.

(56) References Cited

U.S. PATENT DOCUMENTS 4,697,052 A * 9/1987 Ruaud ..... 200/43.07
7,217,159 B2 * 5/2007 Chung ..... 439/607
2003/0207600 A1 * 11/2003 Ho ..... 439/79
2006/0082558 A1 * 4/2006 Chen et al. ..... 345/184

FOREIGN PATENT DOCUMENTS

JP 2001-210176 8/2001

* cited by examiner

*Primary Examiner*—Edwin A. Leon
(74) *Attorney, Agent, or Firm*—Wenderoth, Lind & Ponack, L.L.P.

(57) ABSTRACT

A switch device includes a wiring board having a cutout provided therein, a land provided on an upper surface of the wiring board around the cutout, and a switch. The switch includes a lever, a switch contact activated upon the lever being moved in a predetermined direction, a case including a step portion protruding from a surface thereof and positioned in the cutout of the wiring board, and a terminal protruding from the case and mounted on the land of the wiring board. The switch device securely holds the switch on the wiring board with a simple structure, and allows the switch to be activated reliably.

13 Claims, 3 Drawing Sheets

SWITCH DEVICE

FIELD OF THE INVENTION

The present invention relates to a switch device to be used for operating various electronic apparatuses.

BACKGROUND OF THE INVENTION

Various electronic apparatuses, such as portable telephones and personal computers, have a small size and high performance, and accordingly, a switch device used in such apparatuses is required to be small, thin, and operate reliably.

FIG. 5 is a perspective view of a conventional switch device 501. Slide switch 1 includes case 502 made of insulating resin, lever 3 made of insulating resin, and cover 4 made of thin metal plate. Case 502 has a substantially box shape having an opening in an upper surface of the case. Lever 3 protrudes towards a front from case 502. Cover 4 covers the upper surface of case 502.

Switch contacts, such as a fixed contact and a movable contact, are accommodated in case 502. Upon lever 3 sliding in left and right directions, these switch contacts are electrically connected and disconnected. Plural terminals 5 connected to switch contacts protrude from both sides of a lower surface of case 502.

Plural wiring patterns are formed on upper and lower surfaces of wiring board 6. Plural lands 7 are provided on the upper surface of wiring board 6. Terminal 5 of slide switch 1 is connected to land 7 by, e.g. soldering. Slide switch 1 is mounted to an anterior edge of wiring board 6 while lever 3 protrudes towards the front, thus providing the switch device 501.

Switch device 501 is mounted behind an operating panel of an electronic apparatus while lever 3 protrudes from the operating panel. Terminal 5 of slide switch 1 is connected electrically to an electronic circuit of the electronic apparatus via the wiring pattern on wiring board 6, a connector, or a lead wire connected to the wiring pattern.

Lever 3 protruding from the operating panel is slid in the left or right direction, the switch contacts in case 502 are electrically connected and disconnected. An electrical signal due to the electrical connection and disconnection of the switch contacts is supplied from terminal 5 to the electronic circuit of the electronic apparatus via, e.g. the wiring pattern, thereby switching between various functions of the electronic apparatus.

Lever 3 of slide switch 1 is activated with a force of about 1N to 3N as well as a push button of another switch, such as a push switch including a movable contact having a dome shape. Upon being activated, the displacement of lever 3 is large and ranges from about 2 mm to 3 mm, while the displacement of the push switch ranges from about 0.2 mm to 0.5 mm.

When a large force is applied to lever 3 while being activated, the force applied to case 502 may cause terminal 5 to be peeled from land 7, thus making electrical connection between terminal 5 and land 7 unstable or causing switch 1 to be displaced thereby preventing switch 1 from operating reliably.

A case 502 may accommodate therein a spring for restoring lever 3 to its original position by its elastic restoring force when a hand is released after manipulating lever 3. In the case that slide switch 1 is such an auto-return type slide switch, the spring may produce a shock causing the above problem.

In switch device 501 including slide switch 1, claws provided on a chassis of the electronic apparatus contact right and left sides of switch 1 in order to avoid such problem, hence causing the structure of switch device 501 to be complicated.

SUMMARY OF THE INVENTION

A switch device includes a wiring board having a cutout provided therein, a land provided on an upper surface of the wiring board around the cutout, and a switch. The switch includes a lever, a switch contact activated upon the lever being moved in a predetermined direction, and a case including a step portion protruding from a surface thereof and positioned in the cutout of the wiring board, and a terminal protruding from the case and mounted on the land of the wiring board.

The switch device securely holds the switch on the wiring board with a simple structure, and allows the switch to be activated reliably.

DETAILED DESCRIPTION OF THE INVENTION

Figure 1:
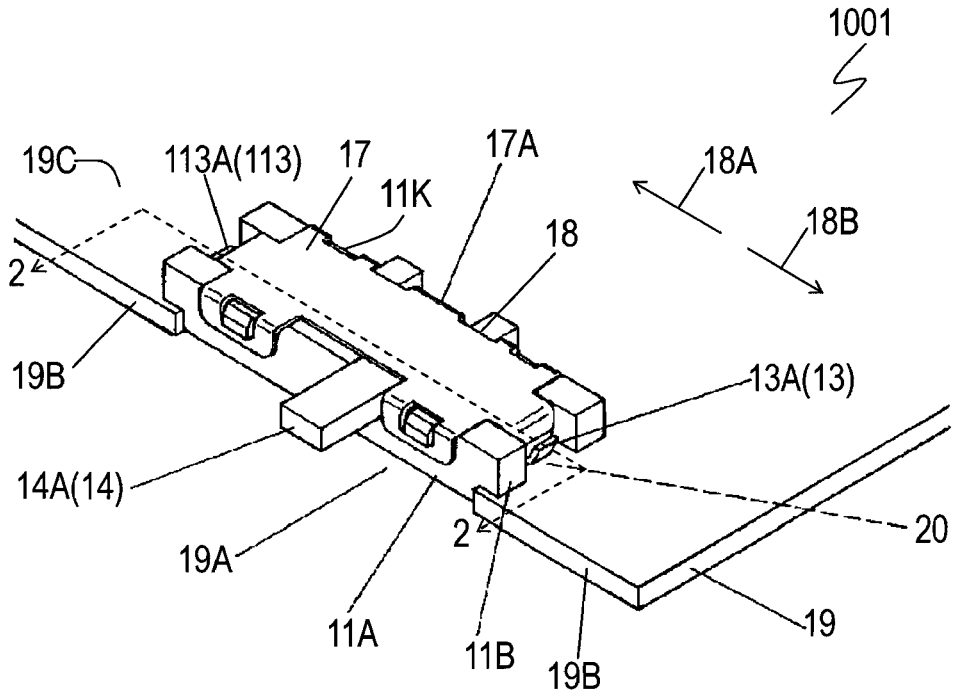
FIG. 1 is a perspective view of a switch device in accordance with an exemplary embodiment of the present invention.

FIG. 1 is a perspective view of switch device 1001 in accordance with an exemplary embodiment of the present invention. Switch device 1001 includes switch 18 and wiring board 19 having switch 18 mounted thereon.

Figure 2:
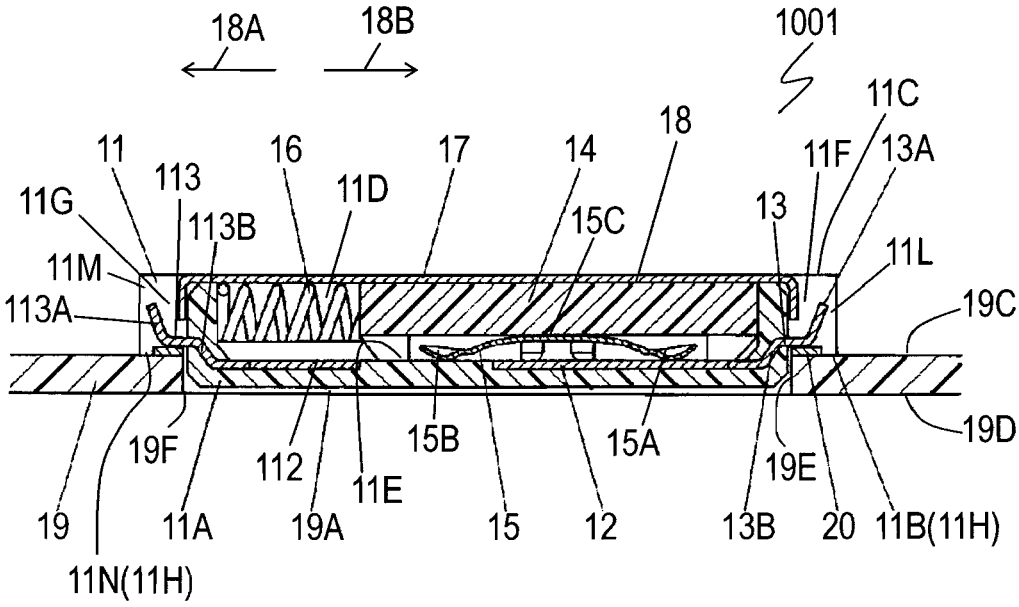
FIG. 2 is a sectional view of the switch device at line 2-2 shown in FIG. 1.
Figure 3:
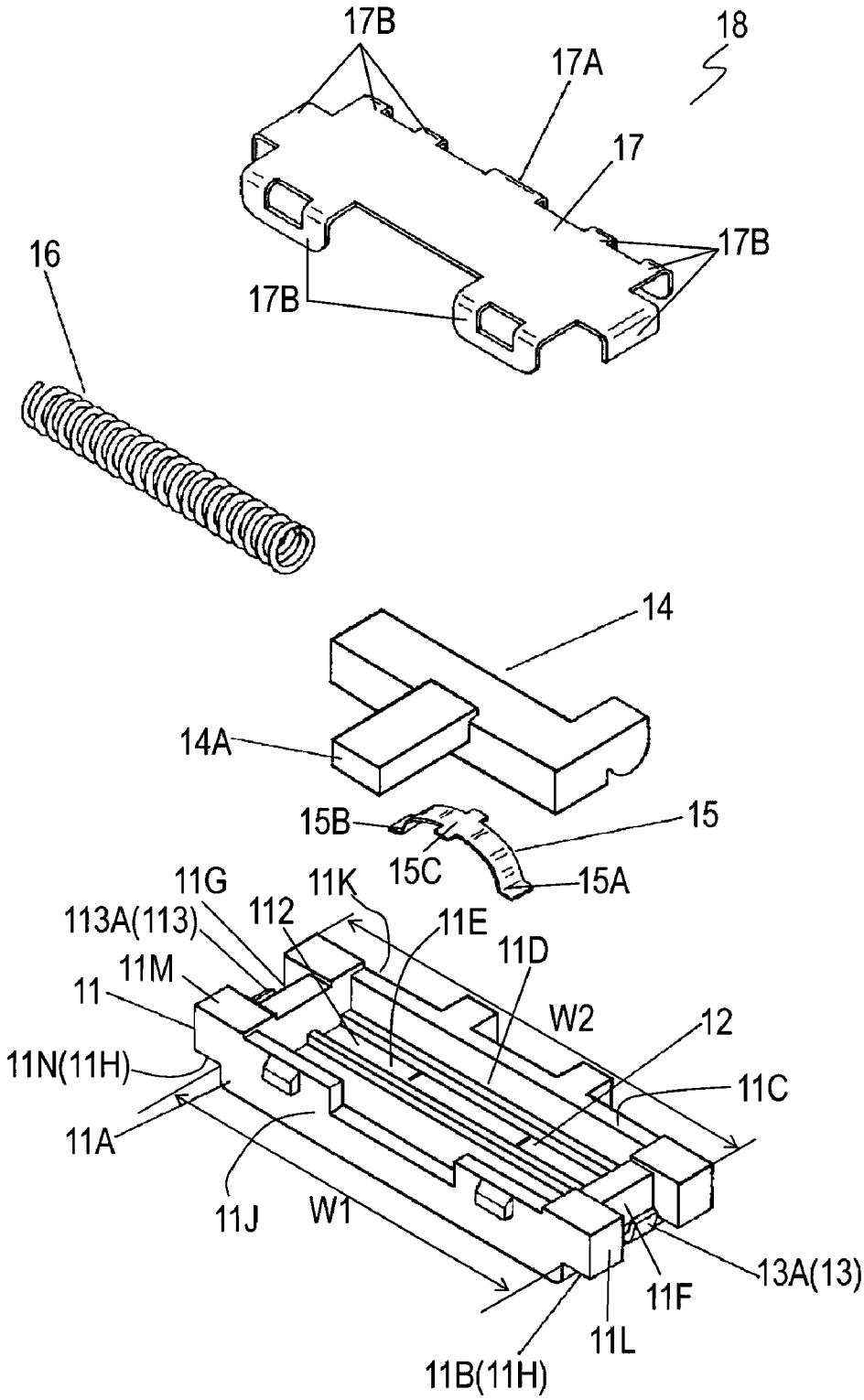
FIG. 3 is an exploded perspective view of a switch of the switch device in accordance with the embodiment.

FIG. 2 is a sectional view of switch device 1001 at line 2-2 shown in FIG. 1. FIG. 3 is an exploded perspective view of switch 18 of switch device 1001. Case 11 is made of insulating resin, such as liquid crystal polymer or polyphenylene sulfide, and has a substantially box shape with recess 11D provided in upper surface 11C of case 11. Recess 11D has bottom 11E. Fixed contacts 12 and 112 are made of conductive thin metal plate, such as copper alloy, are secured to case 11 by insert molding, and are exposed from bottom 11E of recess 11D of case 11.

Terminals 13 and 113 connected to fixed contacts 12 and 112 are formed unitarily with fixed contacts 12 and 112, respectively. Bent portion 13B is provided between fixed contact 12 and terminal 13. Terminal 13 is connected to fixed contact 12 via bent portion 13B. Folded portions 13A and 113A extending upward are provided at the tip of terminals 13 and 113, respectively. Terminals 13 and 113 protrude outward from ends 11F and 11G of case 11 opposite to each other, respectively. Case 11 has step portion 11A that protrudes from lower surface 11H. Width W1 of step portion 11A is smaller than width W2 of the upper part of case 11.

Lever 14 is made of insulating resin, such as liquid crystal polymer or nylon, and is accommodated in recess 11D while being movable in predetermined directions 18A and 18B opposite to each other. Lever 14 has knob 14A protruding from front surface 11J of case 11.

Movable contact 15 is made of elastic thin metal plate, such as copper alloy plate, and is accommodated in case 11. Movable contact 15 has ends 15A and 15B opposite to each other, and middle portion 15C between ends 15A and 15B. Middle portion 15C is fixed to a lower surface of lever 14. Ends 15A and 15B of movable contact 15 contact bottom 11E of recess 11D of case 11 while movable contact 15 sags slightly. Fixed contacts 12 and 112 and movable contact 15 constitute a switch contact accommodated in case 11.

Spring 16 is a coil spring made of elastic wire, such as steel wire. Spring 16 is urged slightly and placed between end 11G of case 11 and lever 14, hence urging lever 14 toward end 11F.

Cover 17 is made of thin metal plate, such as copper plate. Cover 17 has protrusion 17A that protrudes downward along back surface 11K opposite to front surface 11J of case 11. Cover 17 covers recess 11D in upper surface 11C of case 11. Cover 17 has folded back portions 17B provided at both ends and on front and back edges thereof. Folded back portions 17B are held with both sides and front and back sides of case 11, thus providing switch 18. Thus, switch 18 is a slide switch including lever 14 which is movable in directions 18A and 18B opposite to each other.

Figure 4:
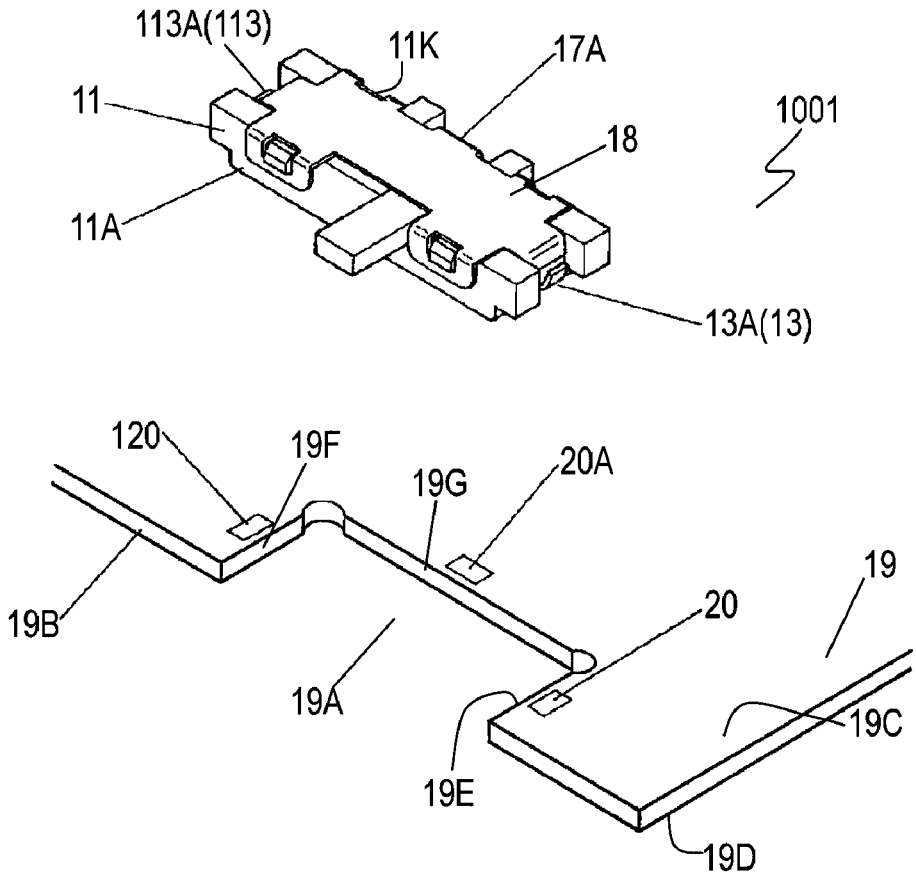
FIG. 4 is an exploded perspective view of the switch device in the embodiment.
Figure 5:
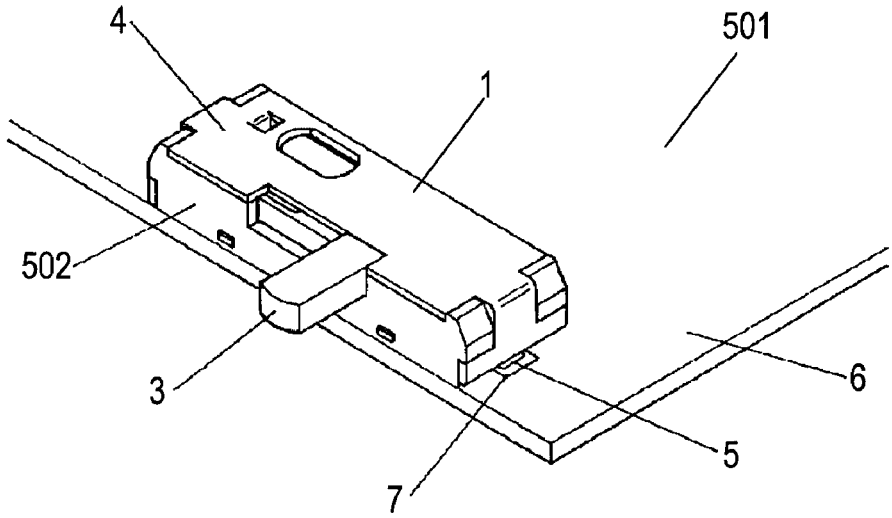
Fig. 5 PRIOR ART
FIG. 5 is a perspective view of a conventional switch device.

FIG. 4 is an exploded perspective view of switch device 1001. Wiring board 19 is made of insulating material, such as paper phenol or glass epoxy. Plural wiring patterns made of conductive material, such as copper foil, are formed on upper surface 19C and lower surface 19D of wiring board 19. Cutout 19A is provided in anterior edge 19B of wiring board 19, and has a width substantially equal to or slightly greater than the width of step portion 11A of switch 18. Plural lands 20, 120, and 20A made of conductive material, such as copper foil, are formed on upper surface 19C around cutout 19A. Wiring board 19 has side edges 19E and 19F and back edge 19G that face cutout 19A. Side edges 19E and 19F are connected to anterior edge 19B. Back edge 19G is connected to side edges 19E and 19F, and is located at the back of cutout 19A. Directions 18A and 18B are parallel to upper surface 19C of wiring board 19. Directions 18A and 18B are parallel, in an exemplary embodiments, to anterior edge 19B. However, directions 18A and 18B are not necessarily parallel to anterior edge 19B. Side edges 19E and 19F face in directions 18A and 18B, respectively.

Step portion 11A of case 11 is inserted into cutout 19A. Terminals 13 and 113 protruding outward from ends 11F and 11G of case 11 are mounted on and connected to lands 20 and 120 by, e.g. soldering, respectively. Protrusion 17A of cover 17 is mounted on and connected to land 20A. As described above, switch 18 is placed such that lever 14 protrudes towards a front from anterior edge 19B of wiring board 19, thus providing switch device 1001.

As shown in FIGS. 1 and 2, bent portions 13A and 113A of terminals 13 and 113 are connected to lands 20 and 120 by, e.g. soldering, respectively. Case 11 has protrusions 11L and 11M protruding from ends 11F and 11G, respectively. Lower surfaces 11B and 11N of protrusions 11L and 11M contact upper surface 19C of wiring board 19. Lower surfaces 11B and 11N of protrusions 11L and 11M are portions of lower surface 11H of case 11. That is, lower surface 11H of case 11 includes lower surfaces 11B and 11N of protrusions 11L and 11M. Step portion 11A is press fit into cutout 19A and contacts side edges 19E and 19F. Alternatively, step portion 11A may be inserted in cutout 19A facing side edges 19E and 19F with a small gap between the step portion and the side edges.

Since the step portion 11A of case 11 is inserted into cutout 19A, the height of switch 18 from upper surface 19C of wiring board 19 is accordingly small, thus providing switch device 1001 with a low profile. Both sides of step portion 11A contact side edges 19E and 19F of cutout 19A or face side edges 19E and 19F with a small gap in a horizontal direction, i.e., an operating direction of lever 14. As shown in FIG. 2, the bottom 11E of the recess 11D is located below the upper surface 19C of the wiring board, and the step portion 11A of the case 11 is located above the lower surface 19D of the wiring board.

Switch device 1001 is mounted behind an operating panel of an electronic apparatus while knob 14A of lever 14 protrudes from the operating panel. Terminal 13 of switch 18 is electrically connected to an electronic circuit of the electronic apparatus via the wiring pattern on upper surface 19C or lower surface 19D of wiring board 19, a connector, or a lead wire connected with the wiring pattern.

An operation of switch device 1001 will be described below. As shown in FIG. 2, when knob 14A of lever 14 is not activated, movable contact 15 contacts fixed contact 12 and does not contact fixed contact 112. Consequently, fixed contacts 12 and 112 are not electrically connected to each other, and thus, the switch contact is not activated. When knob 14A that protrudes from the operating panel of the electronic apparatus having switch device 1001 installed therein is slid in predetermined direction 18A, lever 14 is moved in direction 18A while urging spring 16. This movement causes movable contact 15 fixed to the lower surface of lever 14 to slide while contacting bottom 11E of recess 11D of case 11, and causes movable contact 15 to elastically contact fixed contacts 12 and 112. This operation allows fixed contacts 12 and 112 to be electrically connected via movable contact 15, thus activating the switch contact. The electrical connection of fixed contacts 12 and 112 supplies electric signals from terminals 13 and 113 to the electronic circuit of the electronic apparatus via lands 20 and 120 and the wiring pattern, thereby switching various functions of the electronic apparatus.

When an operational force is relieved by releasing a hand from knob 14A of lever 14 while knob 14A is moved in direction 18A, lever 14 is pushed back in direction 18B opposite to direction 18A due to an elastic restoring force of spring 16, and returns to its original position shown in FIG. 2. Thus, switch 18 is an automatic return switch.

Lever 14 of switch 18 is moved with an operating force ranging from approximately 1N to 3N along a distance ranging from approximately 2 mm to 3 mm. When a large force is applied while lever 14 is activated and moved or when switch 18 receives a shock produced by spring 16 while lever 14 returns to its original position, the operating force or the shock is applied to case 11. In switch device 1001 in accordance with the embodiment, the side surfaces in directions 18A and 18B of step portion 11A of case 11 contact side edges 19F and 19E of cutout 19A of wiring board 19, or face side edges 19F and 19E of cutout 19A with the small gap in between, respectively. This structure prevents the operating force or the shock associated with the activation of lever 14 from being applied to terminals 13 and 113 and lands 20 and 120.

In the case that step portion 11A contacts side edges 19E and 19F of cutout 19A, the operating force or the shock is transmitted from case 11 directly to wiring board 19. Hence, the operating force or the shock associated with the activation of lever 14 is not applied to terminal 13 or 113 or land 20 or 120.

In the case that step portion 11A faces side edges 19E and 19F of cutout 19A with the small gap, case 11 moves in the gap and contacts side edge 19E or 19F of cutout 19A. Since the gap is small, case 11 is displaced by a small distance. This displacement causes bent portions 13B and 113B and terminals 13 and 113 to elastically deform, thus preventing the operating force or the shock from being applied to portions where terminals 13 and 113 and lands 20 and 120 are connected.

Thus, switch device 1001 has a simple structure and prevents terminals 13 and 113 from being peeled from lands 20 and 120 due to the operating force and the shock, and prevents switch 18 from being displaced. Thus, terminals 13 and 113 are securely connected to lands 20 and 120, accordingly allowing switch 18 to be activated reliably.

Switch 18 includes spring 16 for moving lever 14 in the direction 18B. The switch in accordance with the embodiment may not necessarily include spring 16. In this case, an operator slides lever 14 in direction 18B with the same effects.

Switch 18 is a slide switch including lever 14 movable in directions 18A and 18B opposite to each other. In the switch device in accordance with the embodiment, switch 18 may not be the slide switch. Switch 18 may be any switch having a component of a movement of lever 14 in directions 18A and 18B which is not zero, providing the same effects.

Lever 14 of switch 18 is movable in predetermined directions 18A and 18B in parallel to upper surface 19C of wiring board 19. Lever 14 may be movable in directions not parallel to upper surface 19C of wiring board 19. In this case, unless a component of the movement parallel to upper surface 19C of wiring board 19 is zero, the same effects are obtainable for a component of the force or the shock parallel to upper surface 19C of wiring board 19.

Protrusion 17A that extends downward from behind cover 17 is connected to land 20A by, e.g. soldering. This structure allows switch 18 to be securely secured to wiring board 19. Protrusion 17A can be connected to land 20A when terminals 13 and 113 are connected to lands 20 and 120, thereby allowing switch device 1001 to be assembled in a short time.

Terminals 13 and 113 include folded portions 13A and 113A, respectively. Terminals 13 and 113 are connected to lands 20 and 120 at folded portions 13A and 113A by, e.g. soldering, respectively. This structure allows solder to adhere between a side surface of folded portion 13A and land 20 and between a side surface of folded portion 113A and land 120 as well as between terminal 13 and land 20 and between terminal 113 and land 120, thereby connecting terminals 13 and 113 to lands 20 and 120 securely.

Upper surface 19C of wiring board 19 and lower surface 11H of case 11 according to the embodiment do not represent specific absolute directions. Rather, they represent relative directions of components of switch device 1001 and do not represent absolute directions.

What is claimed is:

1. A switch device comprising:

a wiring board having an upper surface, the wiring board having a cutout provided therein;

a land provided on the upper surface of the wiring board around the cutout; and a switch including a lever movable in a predetermined direction, a switch contact activated upon the lever being moved in the predetermined direction, and a case accommodating the switch contact, the case having a lower surface, the case including a step portion protruding from the lower surface and positioned in the cutout of the wiring board; and a terminal protruding from the case, the terminal being mounted on the land of the wiring board;

wherein the case has a recess formed therein, the switch being accommodated in the recess; and wherein the recess has a bottom which faces upward and which is located below the upper surface of the wiring board.

2. The switch device of claim 1, wherein the cutout contacts the step portion.

3. The switch device of claim 1, wherein the cutout is formed in an edge of the wiring board.

4. The switch device of claim 1, wherein the switch contact includes a fixed contact disposed on the bottom of the recess, the terminal has a bent portion connected to the fixed contact, and the terminal has a lower surface located below the upper surface of the wiring board.

5. The switch device of claim 1, wherein the wiring board has a lower surface opposite the upper surface thereof, and the step portion is located above the lower surface of the wiring board.

6. The switch device of claim 1, wherein the cutout is provided in an anterior edge of the wiring board and has a first side edge, a second side edge facing the first side edge, and a back edge located at a back of the cutout, the first side edge being connected to the anterior edge of the wiring board, the second side edge being connected to the anterior edge of the wiring board, the lever is movable in the predetermined direction and in a direction opposite to the predetermined direction, and the first side edge of the cutout faces in the predetermined direction, and the second side edge faces in the direction opposite to the predetermined direction.

7. The switch device of claim 6, wherein the cutout is formed in an edge of the wiring board.

8. The switch device of claim 6, wherein the first side edge of the cutout contacts the step portion.

9. The switch device of claim 8, wherein the second side edge of the cutout contacts the step portion.

10. The switch device of claim 1, wherein the cutout has an edge facing the step portion of the case in a direction opposite said predetermined direction so that, upon movement of the lever in said predetermined direction, the edge of the cutout is contacted by the step portion so as to limit any movement of the case in said predetermined direction caused by a force that moves the lever in said predetermined direction.

11. The switch device of claim 10, wherein the cutout is formed in an edge of the wiring board.

12. The switch device of claim 1, wherein the lever is further movable in a second direction opposite said predetermined direction; and the cutout has first and second side edges facing the step portion of the case in said second direction and said predetermined direction, respectively, so that, upon movement of the lever in said predetermined direction, the first edge of the cutout is contacted by the step portion so as to limit any movement of the case in said predetermined direction caused by a force that moves the lever in said predetermined direction, and so that, upon movement of the lever in said second direction, the second edge of the cutout is contacted by the step portion so as to limit any movement of the case in said second direction caused by a force that moves the lever in said second direction.

13. The switch device of claim 12, wherein the cutout is formed in an edge of the wiring board.

* * * * *